US012049802B1

(12) United States Patent
Rogers et al.

(10) Patent No.: US 12,049,802 B1
(45) Date of Patent: Jul. 30, 2024

(54) FLUID DIVERTER SYSTEM WITH CHAMBER VALVES AND METHOD OF USE

(71) Applicant: Citadel Casing Solutions, LLC, Houston, TX (US)

(72) Inventors: Henry E. Rogers, Owasso, OK (US); Nicolas Rogozinski, Evergreen, CO (US)

( * ) Notice: Subject to any disclaimer, the term of this patent is extended or adjusted under 35 U.S.C. 154(b) by 0 days.

(21) Appl. No.: 18/325,735

(22) Filed: May 30, 2023

Related U.S. Application Data

(60) Provisional application No. 63/346,555, filed on May 27, 2022.

(51) Int. Cl.
*E21B 34/06* (2006.01)

(52) U.S. Cl.
CPC ..... *E21B 34/06* (2013.01)

(58) Field of Classification Search
CPC ..... E21B 21/10; E21B 33/16; E21B 33/165; E21B 34/06
See application file for complete search history.

(56) References Cited

U.S. PATENT DOCUMENTS 8,997,850 B2 * 4/2015 Barbee ..... E21B 33/167 166/70
10,240,429 B2 * 3/2019 Rogozinski ..... E21B 33/165

* cited by examiner

*Primary Examiner* — Matthew R Buck
(74) *Attorney, Agent, or Firm* — Avek IP, LLC

(57) ABSTRACT

A fluid diverter system for use in well drilling operations, the fluid diverter system includes one or more plug chambers mounted within a pipe, and a first valve positioned adjacent to one of the one or more plug chambers, the first valve rotationally mounted within the pipe to selectively rotate between an open position and a closed position, the open position allows fluid flow through a main bore as created by the one or more plug chambers while blocking fluid flow around a perimeter of the one or more plug chambers; and the closed position allows fluid flow around the perimeter of the one or more plug chambers while blocking fluid flow through the main bore; the first valve is machined and manufactured as a single unit.

8 Claims, 6 Drawing Sheets

FLUID DIVERTER SYSTEM WITH CHAMBER VALVES AND METHOD OF USE

RELATED APPLICATIONS

This application claims priority to U.S. provisional application 63/346,555, filed May 27, 2022, which is incorporated by reference in its entirety herein.

FIELD OF THE DISCLOSURE

The disclosure relates generally to fluid diverter systems. More specifically, the disclosure relates to a fluid diverter system with chamber valves manufactured as single piece units that selectively allow for perimeter flow or central bore flow associated with a plug launch apparatus.

BRIEF SUMMARY OF INVENTION

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

In some aspects, the present invention relates to a fluid diverter system for use in well drilling operations, the fluid diverter system comprising an upper plug chamber mounted within a pipe, a lower plug chamber mounted within the pipe, and a first valve separating the upper plug chamber from the lower plug chamber, the first valve rotationally mounted within the pipe to selectively rotate between an open position and a closed position. The open position allows fluid flow through a main bore as created by the upper plug chamber and the lower plug chamber while blocking fluid flow around a perimeter of the lower plug chamber. The closed position allows fluid flow around the perimeter of the lower plug chamber while blocking fluid flow through the main bore. The first valve is machined and manufactured as a single unit.

In other aspects, the present invention relates to a valve for use with a fluid diverter system as part of well drilling operations. The valve comprising a body having a center frame forming a central bore and an outer frame surrounding at least a portion of the center frame, the outer frame forming one or more fluid flow passages between the outer frame and the center frame. The valve is configured to selectively rotate between an open position and a closed position, such that the open position allows fluid flow through the central bore of the body. The closed position allows fluid flow through the one or more fluid flow passages. The first valve is machined and manufactured as a single unit.

BRIEF DESCRIPTION OF THE SEVERAL VIEWS OF THE DRAWINGS

Illustrative embodiments of the present disclosure are described in detail below with reference to the attached drawing figures.

Figure 1:
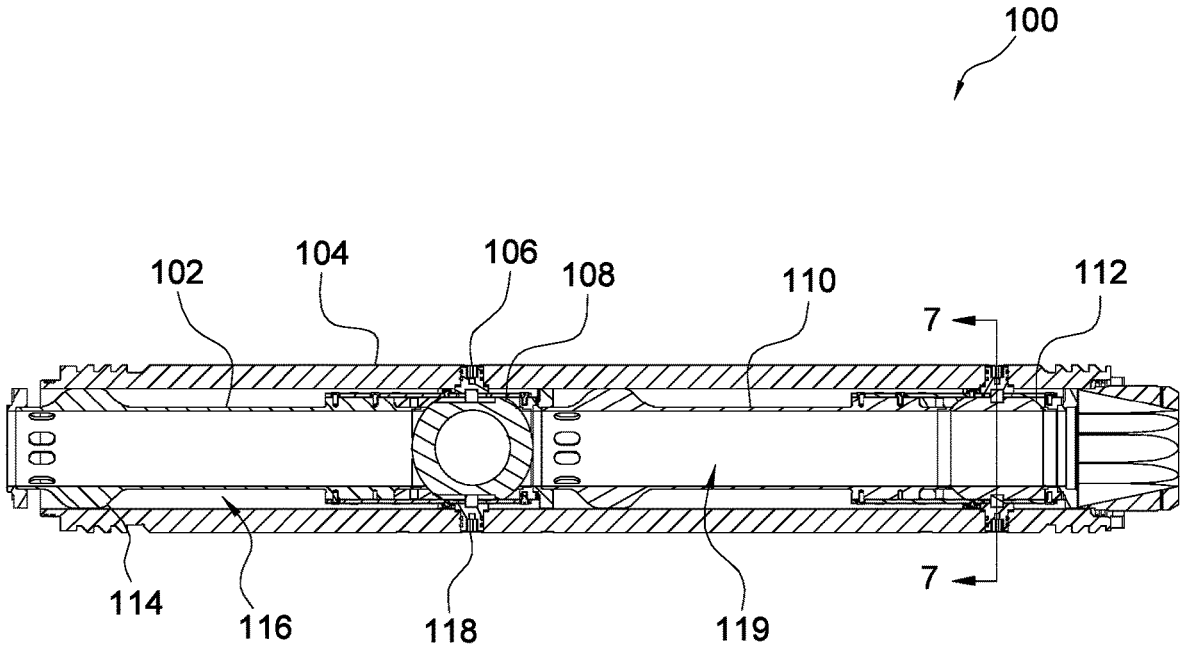
FIG. 1 is a side, cross-sectional view of a fluid diverter system showing an upper valve in a closed position and a lower valve in an open position in accordance with the present invention.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of the equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Well drilling operations are well known in the art, particularly in the oil and gas industry. In surface cementing operations, surface launch cementing plugs are used, wherein a fluid diverter is used for various functions. Fluid diverting systems and assemblies are used to control fluid flow in the well.

The present invention provides for a fluid diverting system, namely a plug launching apparatus having valve(s) manufactured as single units, such that each valve provides the necessary geometry to fully block a main bore of a plug chamber while allowing flow past a perimeter of the plug chamber when in the closed position. Further, when the valve(s) are rotated 90 degrees, the flow path around the perimeter is blocked, preventing fluid flow around the plug chamber, thereby diverting the flow from the perimeter and into the main bore. This flow manipulation is achieved with a single piece assembly valve having no separate wings, fins, bolts, washers, etc. that can come loose or free and pumped down hole.

Figure 2:
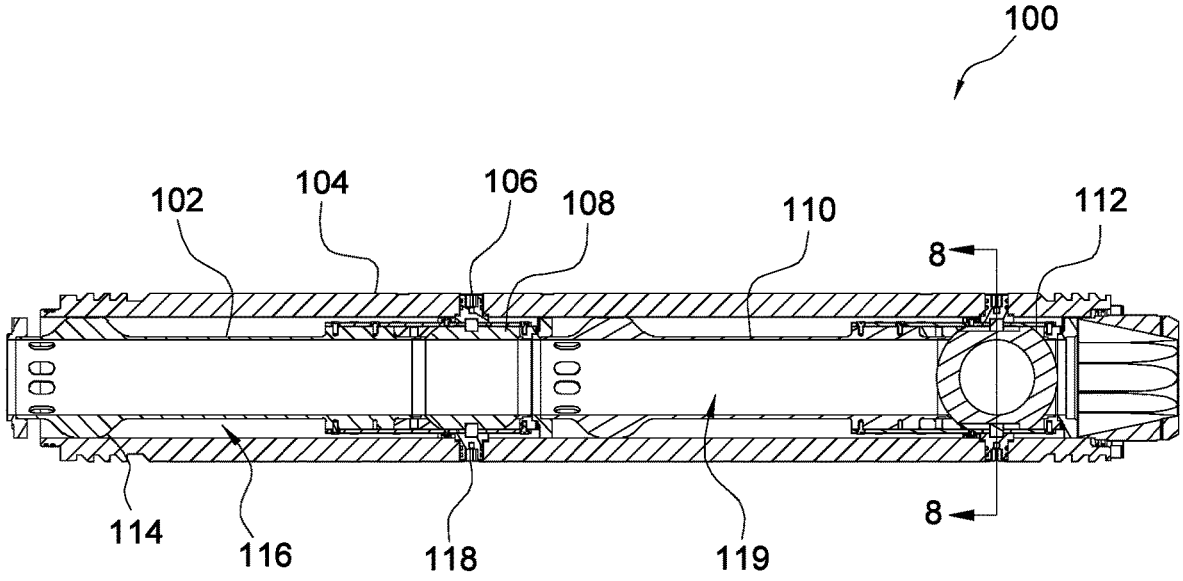
FIG. 2 is a side, cross-sectional view of the fluid diverter system showing the upper valve in an open position and the lower valve in a closed position in accordance with the present invention.

FIGS. 1 and 2 depict a fluid diverter system 100 with unique valves 108, 112 in accordance with the present invention. The system 100 includes an upper plug chamber 102 and a lower plug chamber 110 separated via an upper valve 108 and further having a lower valve 112 at a downhole end of the lower plug chamber 110. Those skilled in the art will appreciate that the plug chambers 102, 110 may vary in design without departing from the novelty of the present invention. The plug chambers 102, 110 are mounted within a pipe 104 such that a perimeter space 116 is created, such as through the use of fins 114 extending from the chambers 102, 110. Again, the exact configurations may vary without departing from the present invention.

Each of the valves 108, 112 is mounted via mounting mechanisms, for example mechanisms 106, 118 that allow for the associated valve 108 to rotate 90 degrees, or from an open position to a closed position and vice versa. FIG. 1 demonstrates upper valve 108 in a closed position and lower valve 112 in an open position. FIG. 2 demonstrates upper valve 108 in an open position and lower valve 112 in a closed position.

Each valve 108, 112 functions to open or close to direct fluid flow as needed during well operations, and as would be understood by those skilled in the art. When in an open position, the valve(s) (i.e. valve 108 or 112) allows fluid flow through a main bore 119 of either or both of the upper plug chamber 102 and the lower plug chamber 110. Alternatively, when in a closed position, the valve(s) block an associated portion of the main bore 119 while directing fluid flow around an exterior of either or both of the plug chambers 102, 110. This is achieved via the configuration of each of the valve(s) 108, 112. Again, those skilled in the art will understand which of the valves 108, 112 to open or closed as needed for a particular well operation.

Figure 3:
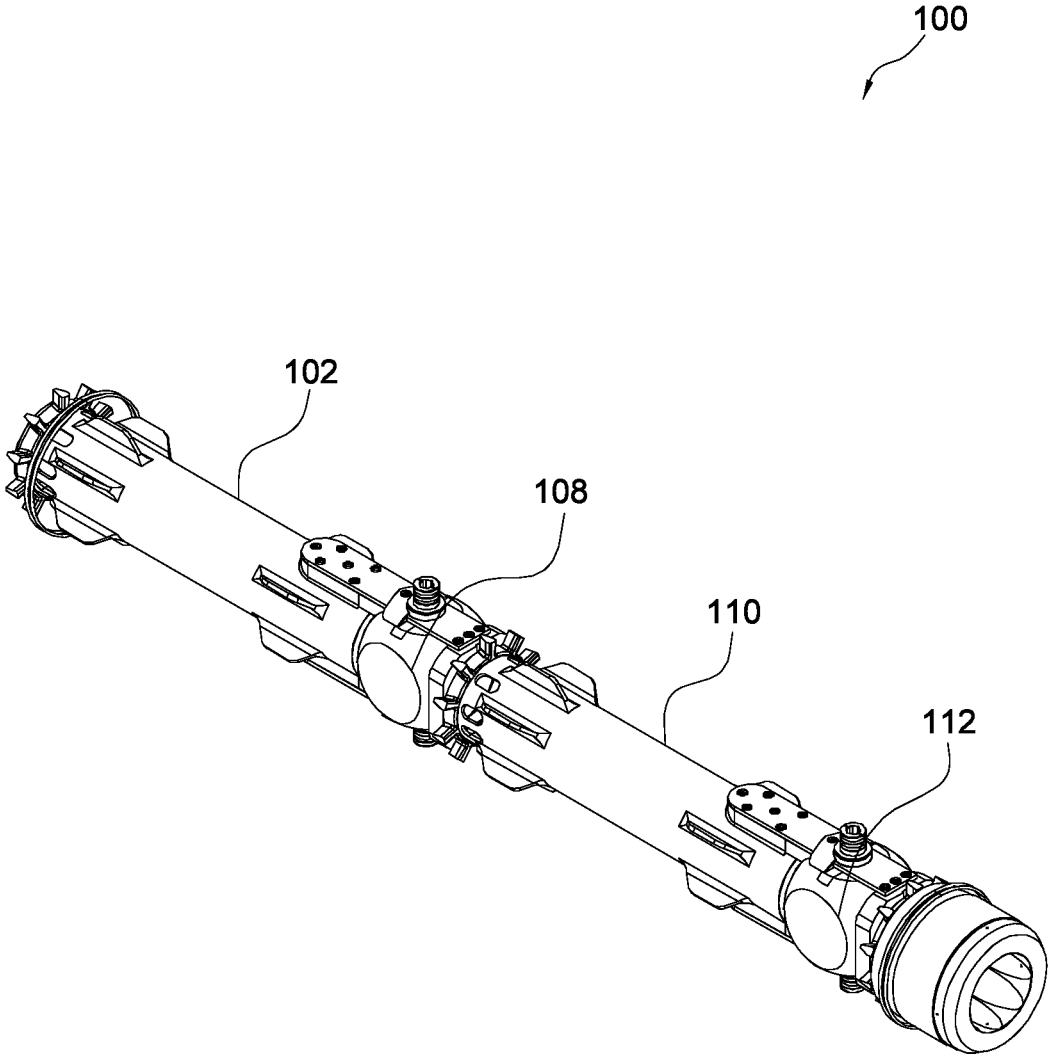
FIG. 3 is an isometric view of the fluid diverter system showing the upper and lower valves in closed positions.
Figure 4:
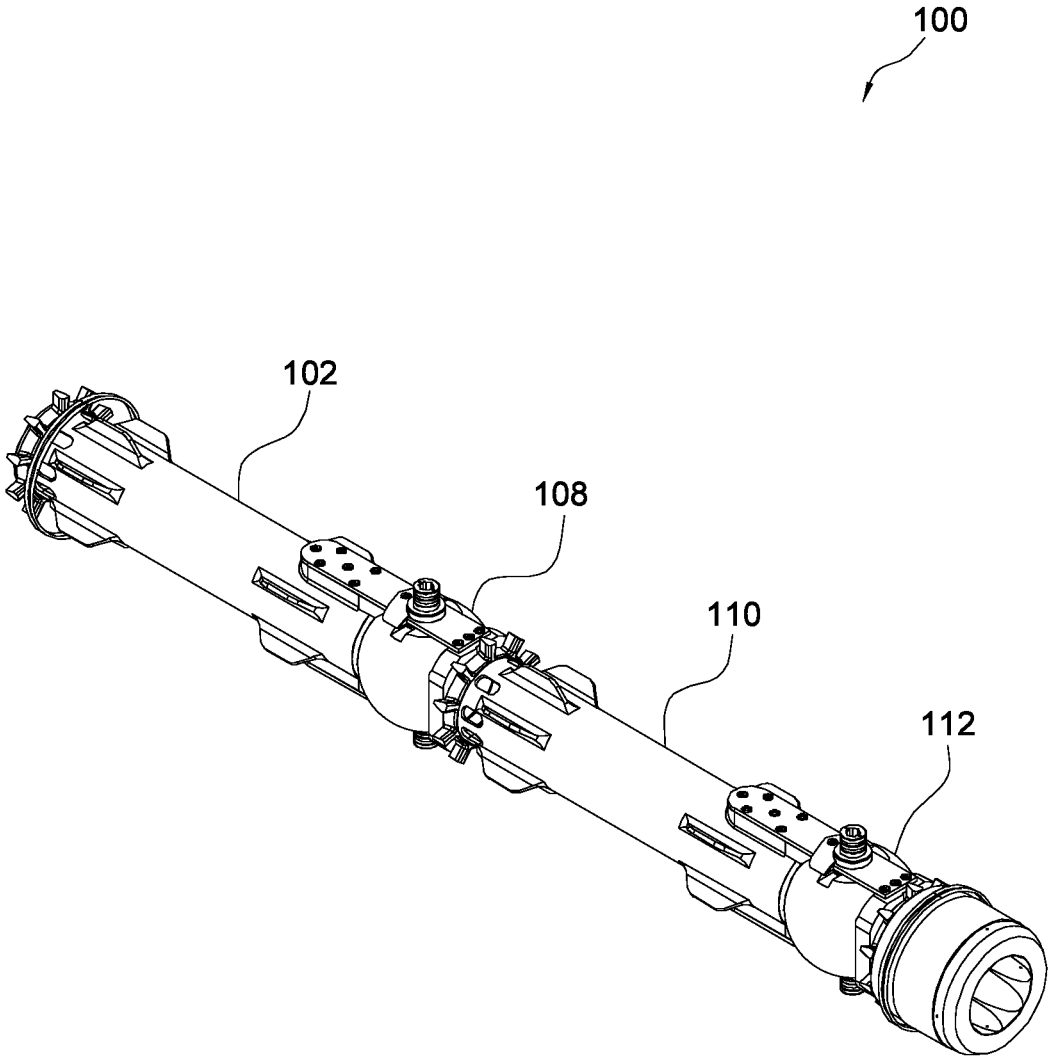
FIG. 4 is an isometric view of the fluid diverter system showing the upper and lower valves in open positions.

FIG. 3 depicts an isometric view of the fluid diverter system 100 (without the exterior pipe 104) with both valves 108, 112 in open positions. FIG. 4 depicts an isometric view of the fluid diverter system 100 (without the exterior pipe 104) with both valves 108, 112 in closed positions.

Figure 5:
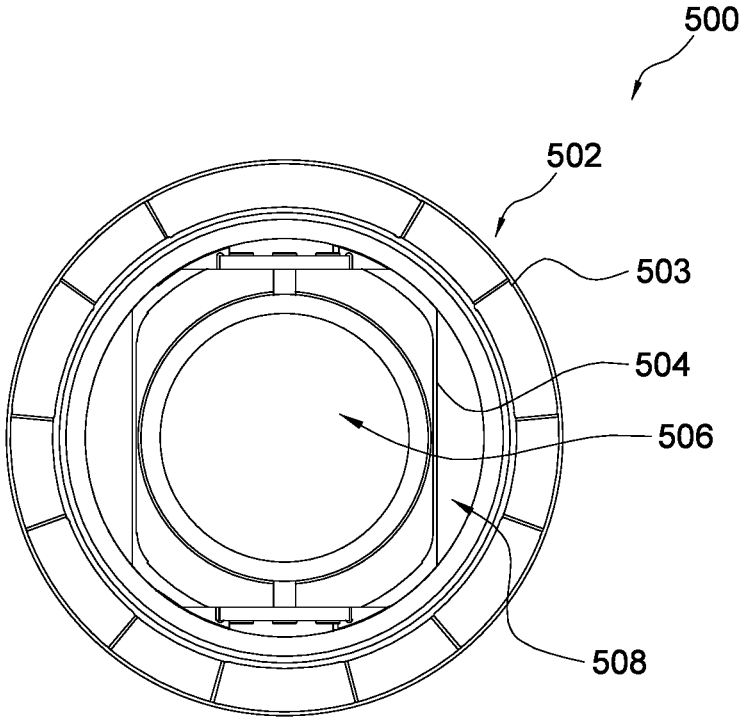
FIG. 5 is an end view showing a valve in an open position.
Figure 6:
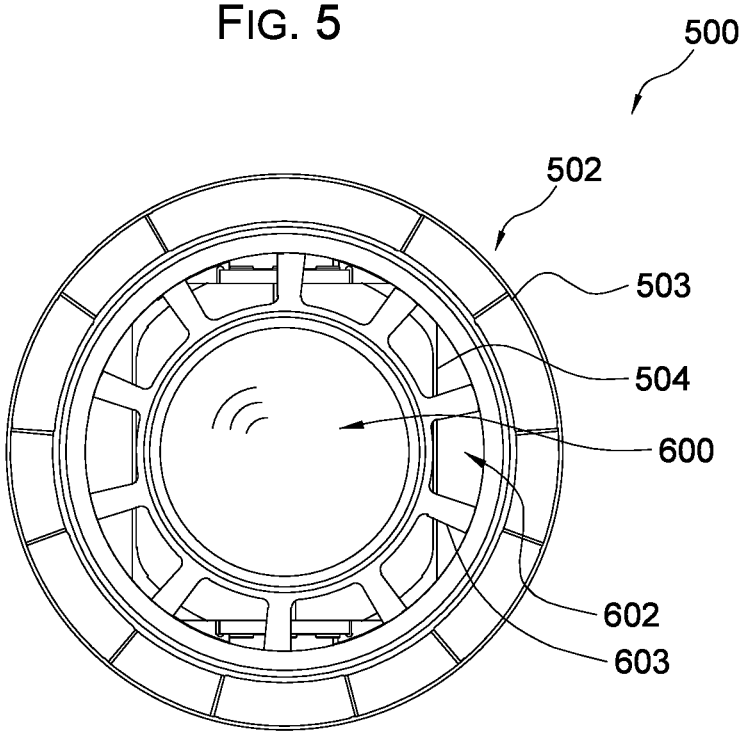
FIG. 6 is an end view showing the valve in a closed position.

FIGS. 5 and 6 depict end views of a valve 500 (i.e. valve 108 or 112) in the open and closed positions respectively. As shown, valve 500 includes a body 502 having an outer frame 503 surrounding a center frame 504 which forms a central bore 506. When in the open position, the central bore 506 is opened and aligned with the main bore 119 of the system 100. Further, when in the open position, a perimeter region 508 is closed from fluid flow. When the valve 500 is closed, as shown in FIG. 6, the main bore area 600 becomes closed, and one or more fluid flow passages 602 are created between the outer frame 503 and the center frame 504 for permitting perimeter flow. In some embodiments, one or more supports 603 extend between the center frame 504 and the outer frame 503.

The valve(s) of the present invention are machined and manufactured as independent, single units, without any wings, fins, bolts, or washers. The single piece chamber valve or fluid diverter mechanism is an improvement on prior art. Specifically, the configuration of a single piece valve/fluid diverter more fully blocks fluid flow around the perimeter of the plug chamber, thus ensuring a more complete diversion of annular fluid flow. Further, the single piece valve/fluid diverter is easier to assemble, maintain, and does not require small pieces that could become loose or detached from the valve to flow down hole during pumping operations.

Figure 7:
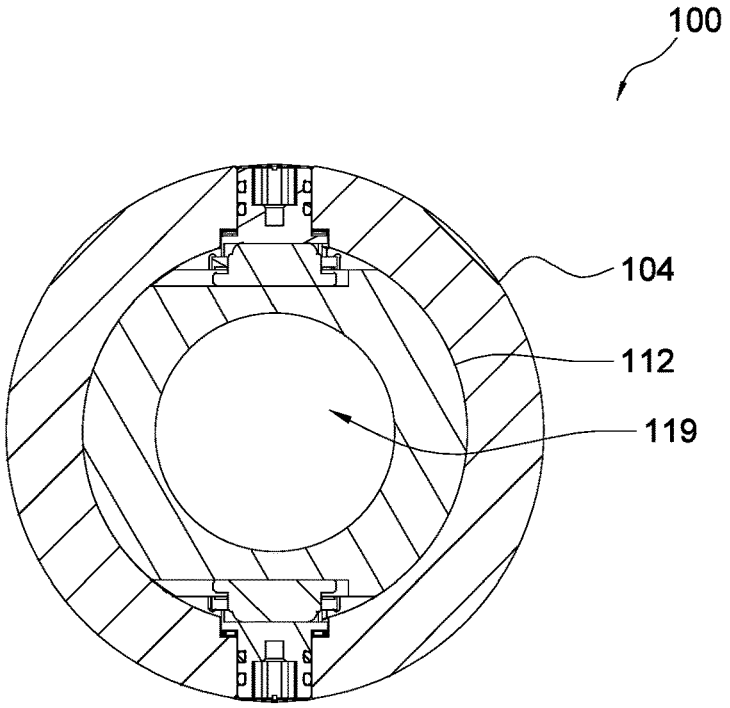
FIG. 7 is an end cross sectional view taken from line 7 of FIG. 1 showing a valve in the open position such that a center bore is open and a perimeter is blocked.
Figure 8:
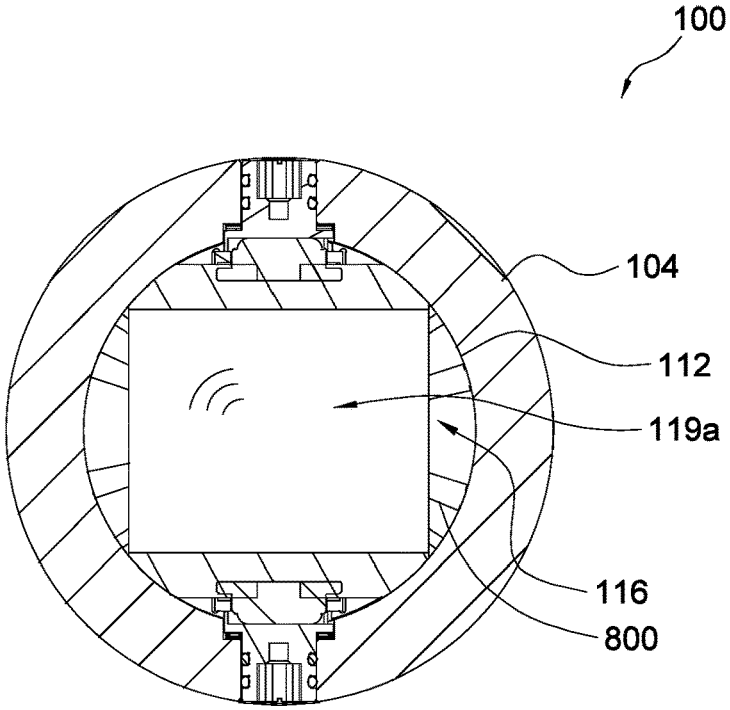
FIG. 8 is an end cross sectional view taken from line 8 of FIG. 2 showing a valve in the closed position such that the center bore is blocked and the perimeter is open to fluid flow.

FIG. 7 depicts a cross sectional view of the system 100 taken from line 7 of FIG. 1. This figure demonstrates valve 112 in the open configuration, such that fluid flow through the main bore 119 is provided, while the perimeter is blocked from fluid flow. Alternatively, FIG. 8 depicts a cross sectional view of the system 100 taken from line 8 of FIG. 2. This figure demonstrates valve 112 in the closed configuration, such that fluid flow through the perimeter 116 space is provided such as between supports 800, while the main bore region 119*a* is blocked.

Figure 9:
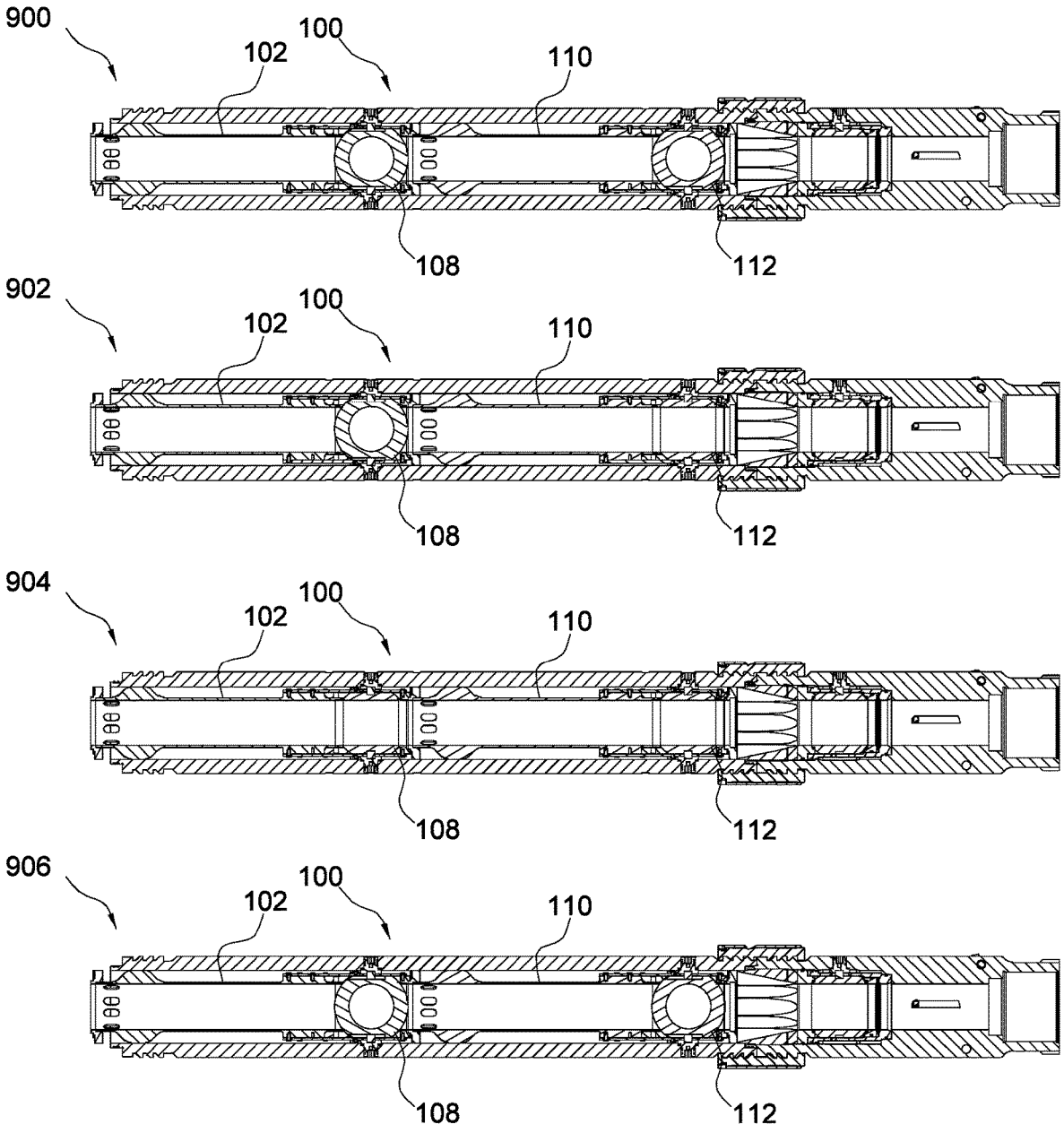
FIG. 9 is a series of cross-sectional views of the fluid diverter system showing an example of sequential configurations of the system.

FIG. 9 shows system 100 in a series of operational views. In view 900, the system 100 is shown with the upper and lower valves 108, 112 both in closed positions. Accordingly, all fluid flow is directed down the perimeter of the plug chambers 102, 110. In view 902, the system 100 is shown with the lower valve 112 in the open position, and the upper valve 108 in the closed position. Accordingly, the lower valve 112 blocks perimeter flow from that point, forcing perimeter fluid flow to be diverted into the upper end of the lower plug chamber 110 and through the main bore 119 of the lower plug chamber. In view 904, the system 100 is shown with both valves 108, 112 in open positions, thereby blocking the perimeter flow path starting at the upper valve 108 and forcing perimeter fluid flow to be diverted into the upper end of the upper plug chamber 102 and through the main bore 119 of the plug chambers 102, 110. Lastly, as shown in view 906, both valves 108, 112 return to closed positions, forcing all fluid flow to pass down the perimeter 116 of the plug chambers 102, 110, thereby evacuating cement or other settable fluids that may have been pumped down the perimeter flow path at any point during the pumping operations.

Those skilled in the art will fully understand the various configurations and uses of the system 100 during well operations and may vary their use as desired and needed based on well parameters.

Again, one of the unique features believed characteristic of the present invention is that the valve(s) 108, 112 are each machined and manufactured as single units. Each valve is a single piece of machined material that provides the necessary geometry to fully block the main bore of the plug chamber while allowing flow past the perimeter of the plug chamber when in the closed position. Then when rotated 90 degrees, the flow path around the perimeter is blocked, preventing fluid flow around the plug chamber, thereby diverting the flow from the perimeter into the main bore. This flow manipulation is achieved with a single piece assembly which has no separate wings, fins, bolts, washers, etc. that can come loose or free and pumped down hole.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

The invention claimed is:

1. A fluid diverter system for use in well drilling operations, the fluid diverter system comprising:

one or more plug chambers mounted within a pipe;

a first valve positioned substantially adjacent to one of the one or more plug chambers, the first valve rotationally mounted within the pipe and selectively rotates from an open position to a closed position, wherein:

the open position allows fluid flow through a main bore as created by the one or more plug chambers while blocking fluid flow around a perimeter of the one or more plug chambers; and the closed position allows fluid flow around the perimeter of the one or more plug chambers while blocking fluid flow through the main bore;

the first valve further includes:

a body having a center frame forming a central bore, the central bore aligns with the main bore when the first valve is in the open position such that fluid can flow therethrough; and an outer frame surrounding at least a portion of the center frame, the outer frame forming one or more fluid flow passages between the outer frame and the center frame such that fluid flows through the one or more fluid flow passages when the first valve is in the closed position;

wherein the first valve is machined and manufactured as a single unit.

2. The fluid diverter system of claim 1, wherein the one or more plug chambers comprises an upper plug chamber and a lower plug chamber.

3. The fluid diverter system of claim 2, further comprising:

a second valve at a downhole end of the lower plug chamber, the second valve configured to rotate from an open position to a closed position; and wherein the first valve is positioned between the upper plug chamber and the lower plug chamber.

4. The fluid diverter system of claim 1, wherein the body, the center frame, and the outer frame are all manufactured and machined as the single unit without any wings, fins, bolts, or washers.

5. The fluid diverter system of claim 1, wherein the first valve further comprises:

one or more supports extending between the center frame and the outer frame.

6. A valve for use with a fluid diverter system as part of well drilling operations, the valve comprising:

a body having a center frame forming a central bore;

an outer frame surrounding at least a portion of the center frame, the outer frame forming one or more fluid flow passages between the outer frame and the center frame;

wherein the valve selectively rotates between an open position and a closed position;

wherein the open position allows fluid flow through the central bore of the body while blocking fluid flow through the one or more fluid flow passages;

wherein the closed position allows fluid flow through the one or more fluid flow passages while blocking fluid flow through the central bore; and wherein the valve is machined and manufactured as a single unit.

7. The valve of claim 6, wherein the body, the center frame, and the outer frame are all manufactured and machined as the single unit without any wings, fins, bolts, or washers.

8. The valve of claim 6, wherein the valve further comprises:

one or more supports extending between the center frame and the outer frame.

* * * * *